US006758434B2

(12) United States Patent
Kapiloff et al.

(10) Patent No.: US 6,758,434 B2
(45) Date of Patent: Jul. 6, 2004

(54) DISPENSER FOR MULTIPLE ROLLS OF SHEET MATERIAL

(75) Inventors: David W. Kapiloff, Gainesville, GA (US); Stephen L. Phelps, Lilburn, GA (US); William G. Haen, DePere, WI (US); Troy E. Westcott, Bonduel, WI (US); Paul A. Haase, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/189,648

(22) Filed: Jul. 3, 2002

(65) Prior Publication Data

US 2004/0004152 A1 Jan. 8, 2004

(51) Int. Cl.[7] ..... B65H 19/00
(52) U.S. Cl. ..... 242/597.8
(58) Field of Search ..... 242/597.5, 597.8, 242/594, 594.5, 591, 597; D6/512

(56) References Cited

U.S. PATENT DOCUMENTS

| | | | | | |
|---|---|---|---|---|---|
| 3,090,572 | A | * | 5/1963 | Metcalf | 242/423.1 |
| 3,294,329 | A | * | 12/1966 | Tucker et al. | 242/560.3 |
| 3,948,454 | A | * | 4/1976 | Bastian | 242/560.3 |
| 4,003,526 | A | | 1/1977 | Fishburn | |
| 4,108,513 | A | * | 8/1978 | Lander | 225/34 |
| 4,375,874 | A | | 3/1983 | Leotta et al. | |
| 4,422,584 | A | | 12/1983 | Dashnier et al. | |
| 4,422,585 | A | | 12/1983 | Schultz et al. | |
| 4,463,912 | A | * | 8/1984 | Grunerud | 242/560.2 |
| 4,557,426 | A | | 12/1985 | Siciliano | |
| 4,606,510 | A | * | 8/1986 | McEntire | 242/560.3 |
| 4,796,832 | A | * | 1/1989 | Schutz et al. | 242/594.5 |
| 4,879,150 | A | * | 11/1989 | Schutz et al. | 428/43 |
| 4,989,800 | A | | 2/1991 | Tritch | |
| 5,294,192 | A | | 3/1994 | Omdoll et al. | |
| 5,310,129 | A | | 5/1994 | Whittington et al. | |
| 5,314,131 | A | | 5/1994 | McCanless et al. | |
| 5,449,127 | A | * | 9/1995 | Davis | 242/560 |
| 5,456,420 | A | | 10/1995 | Frazier | |
| 5,601,253 | A | | 2/1997 | Formon et al. | |
| 5,618,008 | A | * | 4/1997 | Dearwester et al. | 242/594.5 |
| 5,636,812 | A | | 6/1997 | Conner et al. | |
| 5,645,244 | A | | 7/1997 | Moody | |
| 5,669,576 | A | | 9/1997 | Moody | |
| 5,833,169 | A | | 11/1998 | Morand | |
| 6,036,134 | A | * | 3/2000 | Moody | 242/422.4 |
| 6,098,919 | A | | 8/2000 | Lewis | |
| 6,267,321 | B1 | | 7/2001 | Tramontina | |
| 6,302,604 | B1 | * | 10/2001 | Bryant et al. | 400/619 |
| 6,364,245 | B1 | | 4/2002 | Paal et al. | |
| 6,409,120 | B1 | * | 6/2002 | Tramontina et al. | 242/594.5 |

* cited by examiner

*Primary Examiner*—Kathy Matecki
*Assistant Examiner*—Evan Langdon
(74) *Attorney, Agent, or Firm*—Sue C. Watson

(57) ABSTRACT

A dispenser for dispensing rolls of sheet material is provided. The dispenser has a housing which holds one or more rolls of sheet material. The housing has an opening which is defined by a perimeter. A hub which is configured to hold a roll of sheet material is positioned to extend at least partially through the opening, and is moveably retained within the perimeter. An arm supports the hub for pivotable movement on a first end thereof. A portion of the arm is pivotably coupled to a portion of the housing. A second end of the arm is also pivotably movable and configured to be releasably locked into one of a plurality of selected positions.

43 Claims, 4 Drawing Sheets

DISPENSER FOR MULTIPLE ROLLS OF SHEET MATERIAL

FIELD OF THE INVENTION

This invention generally relates to dispensers, and more specifically, to dispensers for rolled sheet material. More particularly, this invention relates to a dispenser for multiple rolls of sheet material.

BACKGROUND

Dispensers for bath tissue used in institutional and public restrooms are often configured to provide a "jumbo" roll of sheet material or bath tissue therein. In addition, some of these dispensers are configured to accommodate a second much smaller roll, or stub roll, which is disposed alongside the jumbo roll. In other dispensers, two or more rolls of equal diameter are disposed therein. Either type of dispenser commonly includes one or more mandrels or hubs which hold the roll(s). Dispensers have therefore been required to be configured to utilize either the jumbo sized roll and the stub roll combination, or the combination of two rolls of equal diameter. Dispensers have not had the flexibility in configuration to permit a choice of diameters of rolls to be positioned therein.

Since various manufacturers offer rolls of sheet material having different diameters, and since prices for such rolls vary, it would be advantageous to have a dispenser that would accommodate several different diameters of rolls, and several different roll combinations. Such a dispenser provides movable mandrels or hubs which permit the use of various diameters of rolls of sheet material, such as bath or toilet tissue, in the dispenser.

DEFINITIONS

As used herein, the term "exit port" or "dispensing opening" is the opening in a housing of a dispenser for the passage of sheet material out of the dispenser.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, spring-loaded hinges, living hinges, and so forth. Living hinges may be constructed from plastic and other materials and formed integrally between two members. A living hinge permits movement, such as, but not by way of limitation, pivotable movement, of one member in relation to another connected member.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, bath/toilet tissue, paper towels, wipes, label rolls, or other fibrous, film, polymers, or filamentary products.

As used herein, the term "couple" includes, but is not limited to, joining, connecting, fastening, linking, or associating two things integrally or interstitially together.

As used herein, the term "arcuate" includes, but is not limited to, having the form generally of a curve or an arch.

SUMMARY OF THE INVENTION

In one aspect of the invention, a dispenser for dispensing rolls of sheet material is provided. The dispenser has a housing which holds one or more rolls of sheet material. The housing has an opening formed therein, which is defined by a perimeter. A hub which is configured to hold a roll of sheet material is positioned to extend at least partially through the opening, and is moveably retained within the perimeter. An arm supports the hub for pivotable movement on a first end thereof. A portion of the arm is pivotably coupled to a portion of the housing. A second end of the arm is also pivotably movable and it is configured to be releasably locked into one of a plurality of selected positions.

In another aspect of the invention, a dispenser for storing and dispensing rolled sheet material is provided. The dispenser has a housing which holds at least two rolls of sheet material. The housing has a pair of spaced-apart openings, and each opening is defined by a perimeter. A pair of hubs, which are each configured to hold a roll of sheet material, are moveably retained within the perimeters of the openings. A pair of arms provide support to the hubs; a hub is positioned on a first end of each arm. The hubs are pivotably moved by the arms within the respective perimeters. A portion of each arm is pivotably coupled to a portion of the housing. A second end of each arm is pivotably movable and it is configured to be releasably locked into one of a plurality of selected positions.

DETAILED DESCRIPTION

Figure 1:
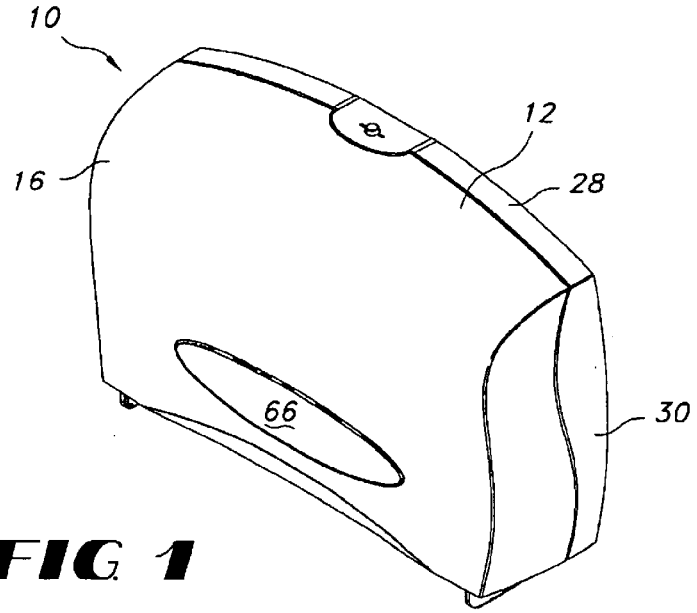
FIG. 1 is a perspective view of a dispenser in accordance with the present invention, in a closed dispensing position.

Reference will now be made in detail to the presently preferred embodiments of the invention, one or more examples of which are illustrated in the drawings. Each example is provided by way of explanation of the invention and is not meant as a limitation of the invention. For example, features illustrated and described as part of one embodiment or figure can be used on another embodiment or figure to yield yet another embodiment. It is intended that the present invention include such modifications and variations.

Figure 2:
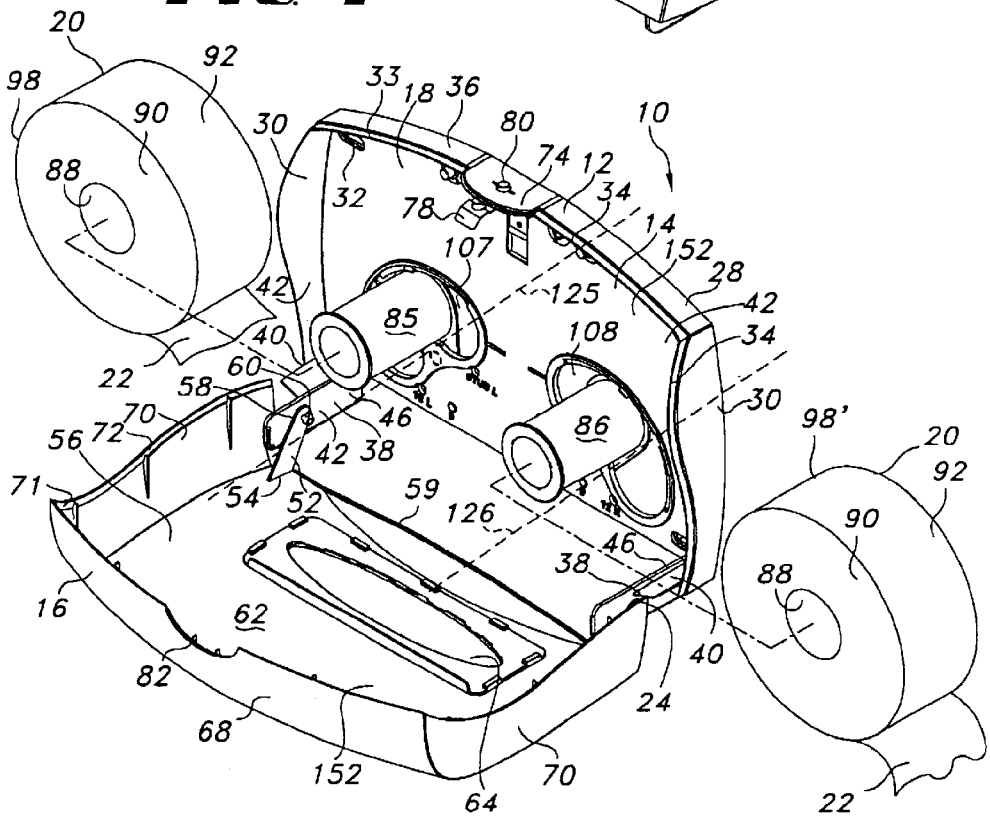
FIG. 2 is a perspective view of the dispenser of the present invention, in an opened, loading position, illustrating a back plate, a cover, two movable hubs, and two mid-sized rolls.

As illustrated in FIGS. 1 and 2, the dispenser 10 includes a housing 12, which has a back plate 14 and a cover 16. The back plate 14 and the cover 16 cooperate when positioned together in a closed position to provide an internal compartment 18 configured to hold one or more rolls 20 of sheet material 22. The back plate 14 and cover 16 also cooperate to form, in a closed position, a dispensing opening or exit port 24 which provides a user access to the sheet material 22, as shown generally in FIGS. 3–5. In the present embodiment, but not by way of limitation, the exit port 24 is provided in a lower end 26 of the housing 12.

The back plate 14 has a top wall 28 which is positioned generally perpendicularly about a portion of its perimeter, as illustrated in FIG. 2. The top wall 28 is contiguous with a pair of spaced-apart opposing side walls 30 which also adjoin the back plate 14. The back plate 14 is configured to be mounted on a surface or wall, such as, by way of non-limiting example, the wall of a toilet stall (not shown). The back plate 14 includes a plurality of openings 32 to permit such mounting via fasteners, brackets, hinges, adhesives, and so forth. Each side wall 30 and the top wall 28 at a common edge 33 thereof includes an inner lip portion 34 which is slightly recessed relative to an outer surface 36 of the back plate 14.

The back plate 14 also includes a pair of spaced-apart and confronting flange and bar assemblies 38 (FIG. 2). Each flange 40 is coupled to or integrally formed with an inner surface 42 near a lower end 44 of each of the side walls 30 of the back plate 14, and has a bar 46 integrally formed therewith or coupled thereto, as shown in FIGS. 2–5. Each bar 46 of the flange and bar assemblies 38 includes a serrated portion 48 along a lower edge and front edge of the bar 46, to permit sections of sheet material 22 to be removed from one or more rolls 20 of sheet material 22 disposed in the internal compartment 18 of the housing 12.

The cover 16, as shown in FIG. 2, is pivotably coupled to the housing 12 via a spaced-apart pair of cover bars 52 which, at a first end 54, are fixedly coupled to or formed integrally with an inner surface 56 of the cover 16. At a second end 58, the cover bars 52 are pivotably coupled via a pivot pin 60, and so forth, to each bar 46 of each of the bar and flange assemblies 38. It will be understood that hinges, fasteners, and so forth may be used to releasably couple the cover 16 to the back plate 14. A lower end 59 of the cover may include a serrated portion as well (not shown).

The cover 16 includes a front plate 62 having a window opening 64 provided therein. A window plate 66 (FIG. 1) is mounted on an inner surface 56 of the front plate 62 over the window opening 64. The window plate 66 is usually, for example, but not by way of limitation, clear, transparent, tinted, and so forth, to provide a view of the size and amount of the remaining roll(s) 20 of sheet material 22 in the dispenser 10 to a user or a maintenance technician. It will be appreciated, however, that any portion(s) of the housing 12 may be clear, transparent, tinted, opaque, and so forth. The front plate 62 includes a contiguous top wall 68 and a pair of spaced-apart opposing side walls 70 which are each formed with and positioned generally perpendicularly to a portion of the perimeter of the front plate 62. The side walls 70 and top wall 68 each include, near a common edge 71, an outer lip portion 72 which is slightly recessed relative to an inner surface 56 of the cover 16.

The top wall 28 of the back plate 14 also includes a convex portion 74 having a latch mechanism coupled thereto, as illustrated in FIG. 2. The latch mechanism includes a latch 78 and a button 80 which are coupled to the inner surface 42 of the back plate 16. The button 80 extends through an opening in the convex portion 74. The top wall 68 of the cover 16 also includes a concave portion 82 configured to receive the convex portion 74 of the top wall 28 of the back plate 16 therein. In addition, the inner surface 56 of the cover 16 includes a reciprocal latch coupler (not shown), which permits the latch 78 to be releasably coupled to the cover 16, thereby permitting the cover 16 to be positioned and maintained in a closed dispensing position relative to the back plate 14. The button 80 may be positioned in a coplanar position relative to the outer surface 36 of the top wall 28, and may include a key hole to permit the latch mechanism to be locked (not shown). Any latch and/or lock mechanism may be used to close/lock the housing 12 to prevent tampering and/or vandalism; many are known in the art.

When the cover 16 is closed against the back plate 14 in the closed dispensing position, the outer lip portion 72 of the cover 16 is cooperatively positioned adjacent the inner lip portion 34 of the back plate 14. Neither the back plate 14 nor the cover 16 includes a bottom wall; therefore, when the housing 12 is in the closed dispensing position, the exit port 24 is provided by the lower end 26 of the housing 12. It will be appreciated that in the present embodiment, the configuration of the housing 12 is not intended as a limitation; other configurations may be used to accommodate aesthetic and/or functional considerations.

As shown in FIGS. 2–7, mounted on the back plate 16 and extending generally perpendicularly therefrom are a pair of mandrels/hubs 85, 86. The hubs 85, 86 each hold a roll 20 of sheet material 22. Such sheet material is often flexible, such as toilet or bath tissue and so forth. Each roll 20 is wound throughout its diameter about a longitudinal open core 88 to form, generally, a cylinder having opposing flat ends 90. The sheet material 22 forming the roll 20 is desirably perforated into sheet sections of predetermined length, although non-perforated sheet material may also be used.

The dispenser 10 and housing 12 are desirably configured to hold at least two rolls 20 of sheet material 22. The rolls 20 are positioned on the hubs 85, 86 such that the core 88 of each roll 20 is mounted on a hub 85, 86 and each roll 20 is mounted with its outer perimeter 92 adjacent the other. One flat end 90 of each roll 20 is positioned adjacent the back plate 14 while the opposite flat end 90 of each roll 20 is positioned adjacent the front plate 62 of the cover 16.

The dispenser 10 of the present embodiment is designed to hold a combination of large, medium, and small rolls, in non-limiting combinations. That is, in a non-limiting example, the dispenser desirably holds within its internal compartment 18 a combination of either: a) a jumbo roll 94, generally, but not by way of limitation, having a diameter greater than about 9.5 inches, and a stub roll 96, generally, but not by way of limitation, having a diameter of less than about 7 inches; or b) two medium-sized rolls 98, 98' (hereinafter termed "mid-sized" roll(s)) generally, but not by way of limitation, having a diameter of greater than about 7 inches to about 9.5 inches. It will be appreciated that the dispenser 10 and the housing 12 may be sized to include additional hubs to hold additional rolls of one or more roll sizes in additional combinations.

Each hub 85, 86 is supported on movement/locking means which includes an arm 100, 101, which is pivotally movable. In addition, the hubs 85, 86 are supported for movement in separate tracks 104, 105, respectively. One of each of the tracks 104, 105 is provided as a portion of a perimeter 106 of each of a pair of openings 107, 108 formed in the back plate 14, which are generally, but not by way of limitation, kidney-shaped. Each opening 107, 108 and therefore each track 104, 105 is positioned, generally, in a spaced-apart mirror image position relative to the other on the back plate 14. In the present embodiment, each track 104, 105 is generally, but not by way of limitation, of a non-linear shape, such as an arcuate shape. Each track 104, 105 is positioned along an upper portion 109 of each perimeter 106 of each opening 107, 108. Each track 104, 105 includes, on the outer surface 36 of the back plate 14, a recessed edge portion 110 which extends across the upper portion 109 of each perimeter 106, defining each track 104, 105. Each opening 107, 108 is sized to receive one of each hub 85, 86, and to accommodate movement of one of each hub 85, 86 within the perimeter 106 of each opening 107, 108. Such movement generally follows, in the present embodiment, but not by way of limitation, an arcuate path. It will be appreciated that other linear and/or non-linear paths are possible as well.

As illustrated in FIGS. 2–7, each hub 85, 86 includes a generally cylindrically-shaped base 111 having a closed end 112, and an opposite open end 114. Each closed end 112 includes a circular flange 116 which is positioned on a portion 118 of the closed end 112, and it extends radially outward a distance from the closed end 112. The circular flange 116 is positioned in a portion of each core 88 of each roll 20 and assists in positioning each roll 20 in alignment within the internal compartment 18, to prevent "dragging" of any portion of the roll 20 against the housing, thereby assisting each hub 85, 86 in holding its respective roll 20 in a dispensing position thereon. Hubs 85, 86 are each mounted on arms 100, 101, respectively, near each open end 114 of each hub 85, 86.

Figure 6:
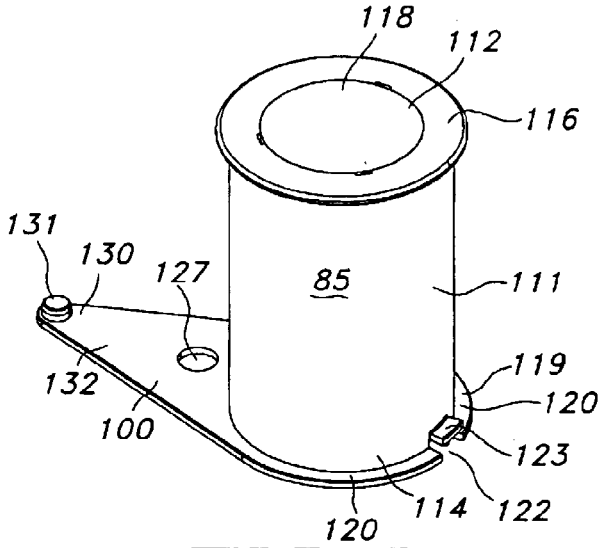
FIG. 6 is a perspective view of one of the hubs illustrated in FIGS. 2–5.
Figure 7:
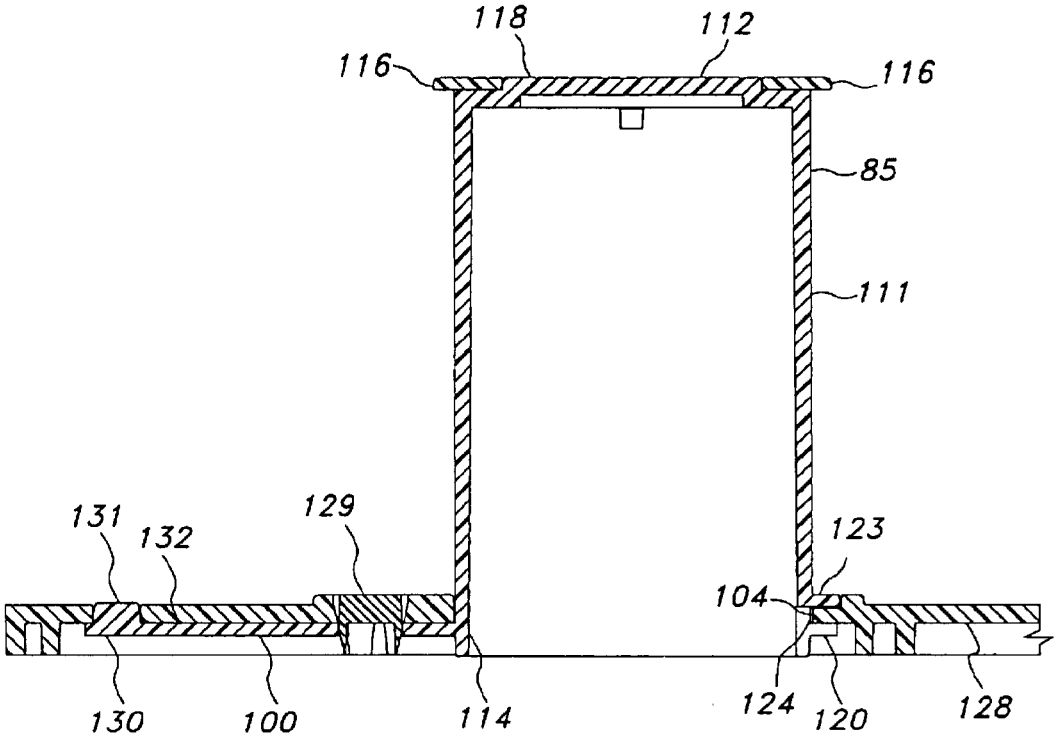
FIG. 7 is sectional view of FIG. 3 taken along line 7—7.

As shown best in FIGS. 6 and 7, each arm 100, 101 supports a hub 85, 86 at a first end 119 thereof, and provides a flange or rail 120 which extends radially about a substantial portion of the base 111 of each hub 85, 86, near the open end 114 thereof. A gap 122 exists in the rail 120, and a small rib rail 123 is positioned on the base 111 of each hub 85, 86 a distance above the gap 122 and the rail 120, to support and stabilize for movement each hub 85, 86 on each track 104, 105, respectively. That is, a groove 124 is formed between the rail 120 and the rib rail 123 which is configured to receive one of each track 104, 105 therein. The rib rail 123 is also configured to be positioned above and against the recessed edge portion 110 of each track 104, 105. The rib rail 123 is configured to slide along the limits of the recessed edge portion 110, while one of the tracks 104, 105, is slidably positioned in the groove 124 between the rail 120 and the rib rail 123.

Each arm 100, 101 is pivotably coupled to the back plate 14, and each arm 100, 101 pivotably moves about an axis 125,126, respectively (FIG. 2). Each arm 100, 101 includes an aperture 127 therein, and each arm 100, 101 is positioned against a back side 128 of the back plate 14 and is pivotably coupled to the back plate 14 via a pivot pin or tab 129 which is positioned in the aperture 127 (FIGS. 6 and 7). At a second end 130 of each arm 100, 101, a tab 131 is provided on an upper surface 132 thereof, which permits each arm 100, 101 to be releasably interlocked to a selected aperture in the back plate 14, thereby securing each arm 100, 101 and therefore each hub 85, 86, respectively, in one of, but not by way of limitation, three positions selected by a maintenance technician. Each arm 100, 101 and the tab 131 thereon are formed from a flexible, resilient material, and cooperate to act as a living hinge, to permit each hub 85, 86 to be positioned in a selected position in each track 104,105, respectvely.

The pivotal movement of arms 100, 101 moves the hubs 85, 86 within the confines of the openings 106, 107 and the tracks 104, 105, respectively. In the present embodiment, each non-linear, arcuate track 104, 105 provides a minor arc, and each hub 85, 86 is movable along the minor arc of each track 104, 105 desirably within a range of 0 to less than about 175 degrees, and more desirably in a range of 0 to less than about 160 degrees, and yet more desirably in a range of 0 to less than about 150 degrees.

Each arm 100, 101 may be locked into a selected one of the three selectable positions via positioning the tab 131 of each arm 100, 101 in one of three apertures 138, 140, 142 which are positioned adjacent each opening 107, 108. Each of the three apertures 138, 140, 142 are positioned and labeled so that a maintenance technician may easily select a position for a roll, based on the size of the roll, and the size of any adjacent roll. Aperture 138 is desirably marked "9" to indicate the position for the mid-sized roll 98, aperture 140 is desirably marked either "12L" or "12R" to indicate the position for the jumbo roll 94, and aperture 142 is desirably marked "Stub L" or Stub R" to indicate the position for the stub roll 96. The number and location of selectable positions may vary as desired.

Figure 3:
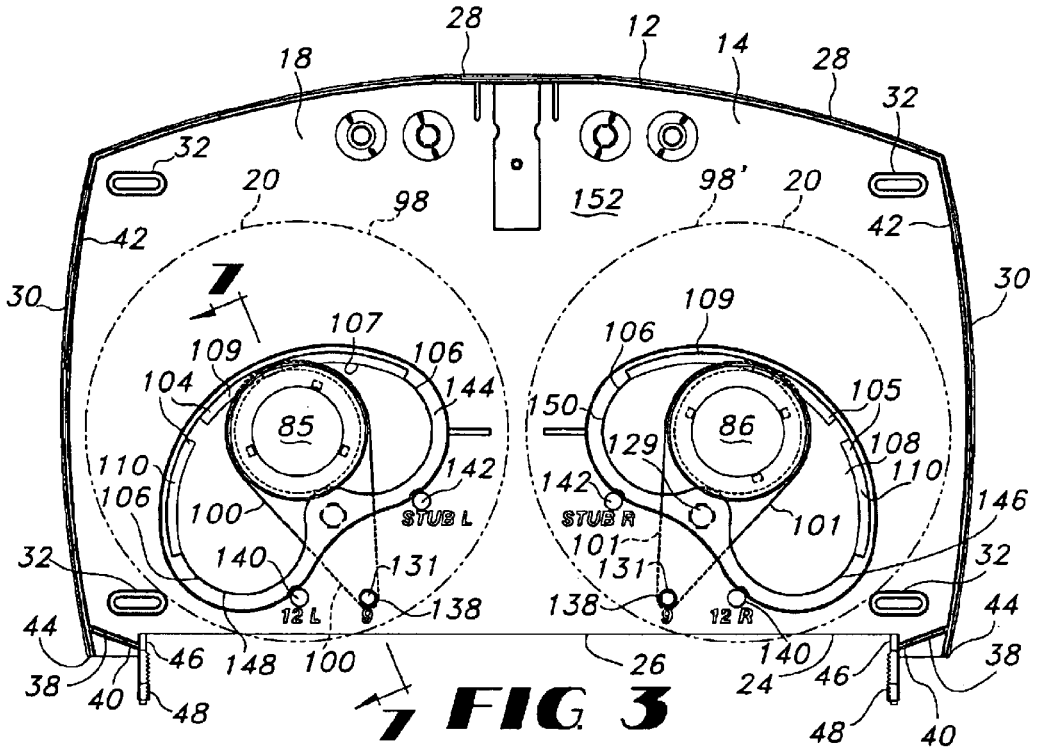
FIG. 3 is a front view of the back plate of the dispenser of FIG. 2, showing the position of the hubs for two rolls of equal diameter (the rolls illustrated in phantom lines)

For example, as illustrated in FIG. 3, the tab 131 of each arm 100, 101 is positioned in aperture 138, which positions the hubs 85, 86 within the perimeter 106 of the openings 107, 108, respectively, in an intermediate position with respect to the tracks 104, 105. Each hub 85, 86 is manually moveable when unlocked, and is easily re-positioned and locked into the newly selected position receive and dispense a mid-sized roll 98, 98', respectively.

Figure 4:
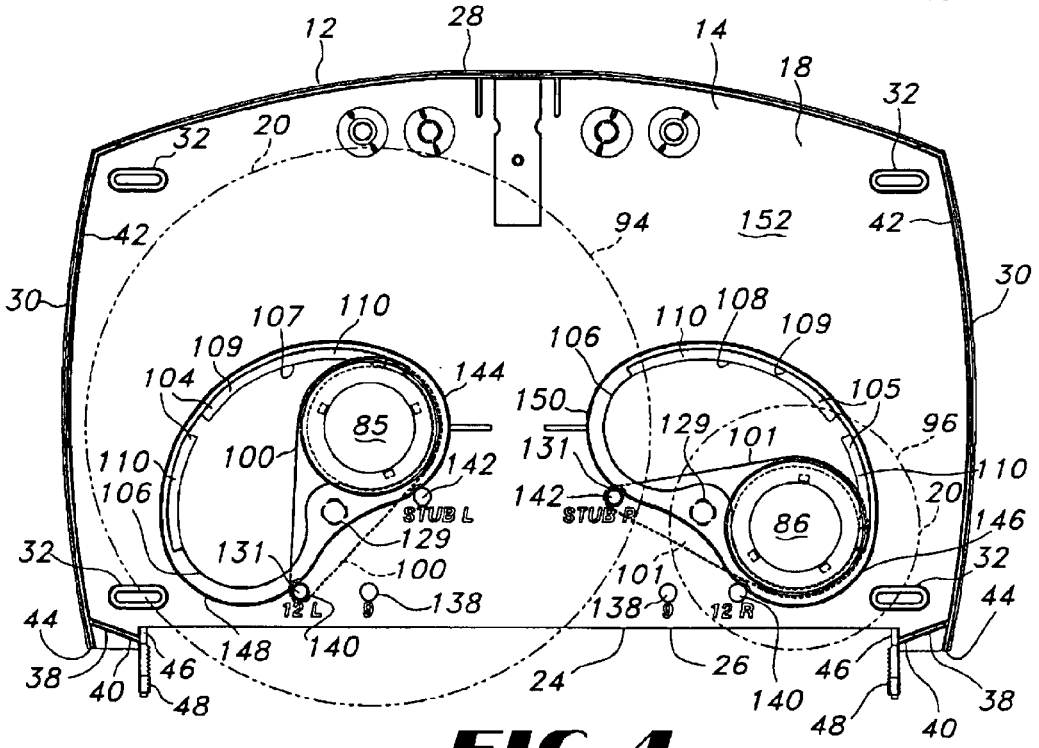
FIG. 4 is a front view of the back plate of the dispenser of FIG. 2, but showing the position of the hubs for a jumbo roll and stub roll combination (the rolls illustrated in phantom lines)

In another example, as illustrated in FIG. 4, the tab 131 of arm 100 is unlocked and hub 85 is manually re-positioned to one end 144 of the perimeter 106 of the opening 107 so that the tab 131 is moved over and positioned in aperture 140 ("12L"), which positions and locks hub 85 into a position to receive and dispense a jumbo roll 94. Adjacent hub 86 is similarly unlocked and the hub 85 is manually re-positioned to an end 146 of the perimeter 106 of the opening 108, so that the tab 131 of arm 101 is moved over and positioned in aperture 142 ("Stub R"), which positions and locks hub 86 into a position to receive and dispense a stub roll 96, thereby cooperating with the hub 85 to permit both the jumbo roll 94 and the stub roll 96 to be positioned in the housing 12 for dispensing to a user.

Figure 5:
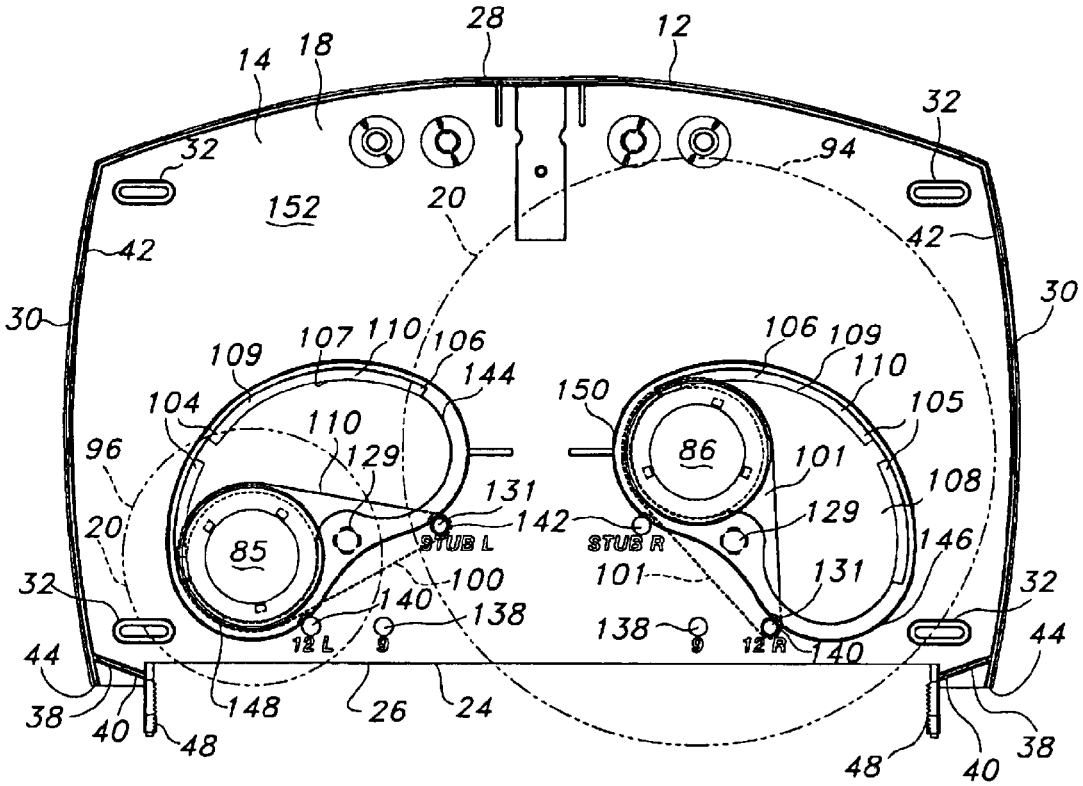
FIG. 5 is a front view of the back plate of the dispenser of FIG. 2, but showing the position of the hubs for a stub roll and jumbo roll combination (the rolls illustrated in phantom lines)

In yet another example, as illustrated in FIG. 5, the tab 131 of arm 100 is unlocked and hub 85 is manually re-positioned to an end 148 of the perimeter 106 of the oening 107 so that the tab 131 is moved over and positioned in aperture 142 ("Stub L"), which positions and locks hub 85 into a position to receive and dispense a stub roll 96. Adjacent hub 86 is likewise unlocked and the hub 85 is manually re-positioned to an end 150 of the perimeter 106 of the opening 108, so that the tab 131 of arm 101 is moved over and positioned in aperture 140 ("12R"), which positions and locks hub 86 into a position to receive and dispense a jumbo roll 94, thereby cooperating with hub 85 to permit both the stub roll 96 and the jumbo roll 94 to be positioned in the housing 12 of the dispenser for dispensing. Other roll size combinations may be used, the foregoing examples are meant to be illustrative of three combinations which are desirable.

In a method of use, generally shown in FIGS. 1–5, the cover 16 is moved away from the back plate 14, as illustrated in FIGS. 2, thereby positioning the housing 12 in an opened loading position. Each hub 85, 86 may be released from its locked position relative to the back plate 14 by a maintenance technician, who manually pushes the tab 131 of each hub 85, 86, out of the aperture, namely, 138, 140, or 142 in which it was previously inserted by using, for example, the pointed end of a small screw driver, or other device (not shown). By unlocking each tab 131 on each arm 100, 101, each hub 85, 86, respectively, is unlocked from its previously-selected position and is movably along the length of the track 104, 105, respectively. This allows each hub 85, 86, to be pivotably moved by the maintenance technician to a newly selected position, and locked via the tab 131 as described previously into another selected position. Each hub 85, 86, may be moved to a preselected position as described above, to desirably, but not by way of limitation, hold a combination of either a jumbo roll 94 and a stub roll 96, or two mid-sized rolls 98, 98'.

The selected rolls are mounted on the hubs 85, 86, and the housing 12 is closed as described previously herein. The sheet material 22 from each roll 20 is ready to be dispensed to a user through the exit port 24.

It will be appreciated that the present movable hubs 85, 86 are moved within the confines of the internal compartment 18 of the housing 12 to allow different sizes of rolls to be contained therein, in various combinations. The hubs 85, 86 do not move to position a roll closer to the exit port 24; rolls of all sizes shown and described herein are already positioned adjacent the exit port 24 for a user to access one or both rolls, as desired. Further, it will be understood that each hub 85, 86 is configured to be positioned within the internal compartment 18 of the housing 12 to rotatably support one of a jumbo roll 94, a mid-sized roll 96, and a stub roll 98 without an outer perimeter 92 of the roll 20 substantially contacting an inner surface 152 (FIGS. 2–5) of the housing 12 or another, adjacent roll 20.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for storing and dispensing rolled sheet material, comprising:

a housing configured to hold at least one roll of sheet material therein and formed to include an exit port, the housing having a backside and an opening in the backside defined by a perimeter;

a hub configured to hold a roll of sheet material thereon, the hub positioned to extend at least partially through the opening in the housing and being moveably retained within the perimeter; and an arm supporting the hub on a first end thereof for movement of the hub within the perimeter, the arm positioned against the backside of the housing, a portion of the arm pivotably coupled to a portion of the housing and a second end of the arm pivotably movable against the backside of the housing and configured to be releasably locked into one of a plurality of selected positions.

2. The dispenser of claim 1, wherein the housing includes a cover and a back plate, and the back plate includes the backside.

3. The dispenser of claim 2, wherein the opening is formed in the backplate, and the perimeter includes a track formed on a portion thereof.

4. The dispenser of claim 3, wherein the track is further defined as having a substantially arcuate configuration.

5. The dispenser of claim 3, wherein the hub is movably positioned against the track and the hub is moveable only within the confines of the track.

6. The dispenser of claim 5, wherein the hub has a pair of spaced-apart rails, and each track is positioned between the rails.

7. The dispenser of claim 2, wherein the arm is positioned against the backside of the back plate and coupled to the backside of the back plate via a pivot pin.

8. The dispenser of claim 7, wherein the second end of the arm includes a hinge having a tab thereon which is inserted into one of a plurality of apertures provided in the backplate to releaseably lock the arm to the back plate.

9. The dispenser of claim 8, wherein the second end of the arm is unlocked from the back plate when the tab is moved out of the one aperture.

10. The dispenser of claim 1, wherein the hub is configured to be positioned relative to an inner surface of the housing to rotatably support one of a jumbo roll, a mid-sized roll, and a stub roll without an outer perimeter of the roll substantially contacting the inner surface of the housing.

11. A dispenser for storing and dispensing rolled sheet material, the dispenser comprising:

a housing configured to hold at least two rolls of sheet material therein and formed to include an exit port, the housing having a pair of spaced-apart openings, each opening defining by a perimeter, the housing having a backside;

a pair of hubs, each hub configured to hold a roll of sheet material thereon and one of each of the hubs being moveably retained within the perimeter of one of the openings; and a pair of arms, each arm configured to support on a first end thereof one hub for movement of the hub within the perimeter, each arm positioned against the backside of the housing, a portion of each arm being pivotably coupled to a portion of the housing and a second end of each arm pivotably movable against the backside of the housing and configured to be releasably locked into one of a plurality of selected positions.

12. The dispenser of claim 11, wherein the housing includes a cover and a back plate, and the back plate includes the backside.

13. The dispenser of claim 12, wherein each opening is formed in the back plate, and the perimeter of each opening includes a track formed on a portion thereof.

14. The dispenser of claim 13, wherein each track is further defined as having a substantially arcuate configuration.

15. The dispenser of claim 14, wherein each track is positioned on the back plate in a mirror image position relative to the other.

16. The dispenser of claim 13, wherein each hub has a pair of spaced-apart rails, and each track is positioned between the rails.

17. The dispenser of claim 12, wherein each arm is positioned against the backside of the back plate and coupled to the backside of the back plate via a pivot pin.

18. The dispenser of claim 17, wherein the second end of each arm includes a hinge having a tab thereon which is inserted into one of a plurality of apertures provided in the back plate to releasably lock each arm to the back plate.

19. The dispenser of claim 18, wherein the second end of each arm is unlocked from the back plate when the tab is moved out of the one aperture.

20. The dispenser of claim 11, wherein each hub is movable to hold one of a jumbo roll, a stub roll, and a mid-sized roll.

21. The dispenser of claim 11, wherein the hubs together are selectively positioned to cooperate to hold one of rolls of substantially different diameters and rolls of substantially similar diameters.

22. The dispenser of claim 11, wherein the hubs together cooperate to hold a combination of one of a jumbo roll and a stub roll, and two mid-sized rolls.

23. A dispenser for storing and dispensing rolled sheet material, comprising:

a housing configured to hold at least one roll of sheet material therein and formed to include an exit port, the housing having a backside and an opening defined by a perimeter;

at least one hub configured to hold a roll of sheet material thereon, the hub positioned to extend at least partially through the opening in the housing and being moveably retained within the perimeter; and movement/locking means supporting the hub on one end for pivotable movement while simultaneously on an opposite end releasably locking the hub into one of a plurality of selected positions, the movement/locking means is positioned against the backside of the housing.

24. The dispenser of claim 23, wherein the housing includes a cover and a back plate, and the back plate includes a backside.

25. The dispenser of claim 24, wherein the movement/locking means includes an arm supporting a hub at a first end thereof which is pivotably coupled to the backside of the back plate.

26. The dispenser of claim 25, wherein the arm includes a second end configured to be releaseably locked to the back plate.

27. The dispenser of claim 26, wherein the second end includes a hinge having a tab thereon which is inserted into one of a plurality of apertures provided in the back plate to releasabley lock the arm to the back plate.

28. The dispenser of claim 27, wherein the second end of the arm is unlocked from the back plate when the tab is moved out of the one aperture.

29. The dispenser of claim 23, wherein the hub is configured to hold one of a jumbo roll, a stub roll, and a mid-sized roll.

30. A method of positioning hubs in a dispenser adapted to hold at least two rolls of sheet material, the method comprising:

providing the dispenser of claim 2;

selecting a position for each hub such that the hubs are positioned to cooperate to hold one of rolls of substantially different diameters and rolls of substantially identical diameters without a substantial portion of an outer perimeter of a roll contacting an inner surface of the housing;

unlocking each arm and moving the hub thereon to the selected position;

locking each arm into the selected position thereby retaining each hub in the selected position; and disposing a roll of sheet material of a selected diameter on the hub.

31. The method of claim 30, wherein in the step of selecting a position for each hub, the step further includes selecting a position for a combination of one of a jumbo roll and a stub roll, and two mid-sized rolls.

32. The method of claim 30, wherein in the step of unlocking each arm and moving the hub thereon to the selected position, the step further includes moving a tab provided on the arm out of one aperture and pivotably moving the arm such that the tab is in alignment with and positioned in another aperture.

33. A dispenser for storing and dispensing rolled sheet material, comprising:

a housing configured to hold at least one roll of sheet material therein and formed to include an exit port, the housing having a backside and an opening in the backside defined by a perimeter;

a hub configured to hold a roll of sheet material thereon, the hub positioned to extend at least partially through the opening in the backside and being moveably retained within the perimeter; and an arm supporting the hub on a first end thereof for movement of the hub within the perimeter, a portion of the arm pivotably coupled to a portion of the housing and a second end of the arm pivotably movable and configured to be releasably locked into one of a plurality of selected positions.

34. The dispenser of claim 33, wherein the housing includes a cover and a back plate, and the back plate includes the backside.

35. The dispenser of claim 34, wherein the opening is formed in the backplate, and the perimeter includes a track formed on a portion thereof.

36. The dispenser of claim 35, wherein the track is further defined as having a substantially arcuate configuration.

37. The dispenser of claim 35, wherein the hub is movably positioned against the track and the hub is moveable only within the confines of the track.

38. The dispenser of claim 37, wherein the hub has a pair of spaced-apart rails, and each track is positioned between the rails.

39. The dispenser of claim 34, wherein the arm is positioned against the backside of the back plate and coupled to the backside of the back plate via a pivot pin.

40. The dispenser of claim 39, wherein the second end of the arm includes a hinge having a tab thereon which is inserted into one of a plurality of apertures provided in the backplate to releaseably lock the arm to the back plate.

41. The dispenser of claim 40, wherein the second end of the arm is unlocked from the back plate when the tab is moved out of the one aperture.

42. The dispenser of claim 34, wherein the hub is configured to be positioned relative to an inner surface of the housing to rotatably support one of a jumbo roll, a mid-sized roll, and a stub roll without an outer perimeter of the roll substantially contacting the inner surface of the housing.

43. The dispenser of claim 33, wherein the second end of the arm is configured to be releasably locked into one of a plurality of selected positions outside the perimeter.

* * * * *